US005722273A

United States Patent [19]

Lin et al.

[11] Patent Number: 5,722,273

[45] Date of Patent: Mar. 3, 1998

[54] LATCH BOLT OPERATING DEVICE

[75] Inventors: San-Yi Lin, Yun-Lin Hsien, Taiwan; Ching-Chuan Kuo, Chia-Yi Hsien, Taiwan; Tong-Pei Wu, Chia-Yi Hsien, Taiwan; Lan-Kun Don, Chia-Yi Hsien, Taiwan; Sheen-Youl Gao, Yun-Lin Hsien, Taiwan

[73] Assignee: Tong Lung Metal Industry Co., LTD., Taiwan

[21] Appl. No.: 628,848

[22] Filed: Apr. 8, 1996

[51] Int. Cl.[6] ..... E05B 9/04

[52] U.S. Cl. ..... 70/370; 70/417; 70/449; 70/451; 70/452; 292/147; 292/357

[58] Field of Search ..... 70/373, 224, 371, 70/417, 134, 370, 447–452; 292/357, 356, 147

[56] References Cited

U.S. PATENT DOCUMENTS

| | | | |
|---|---|---|---|
| 2,697,342 | 12/1954 | Mc Connell et al. | 70/224 |
| 3,713,683 | 1/1973 | Neary | 70/451 X |
| 4,073,172 | 2/1978 | Schlage | 70/417 |
| 4,338,804 | 7/1982 | Solovieff | 70/417 X |
| 4,587,816 | 5/1986 | Garcia | 70/417 |
| 5,018,375 | 5/1991 | Tully | 70/224 X |
| 5,149,155 | 9/1992 | Caeti et al. | 292/357 X |
| 5,150,592 | 9/1992 | Lin | 70/224 X |
| 5,199,285 | 4/1993 | Lin | 70/224 X |
| 5,216,910 | 6/1993 | Lin | 70/370 |
| 5,540,070 | 7/1996 | Adelmeyer | 70/370 |

*Primary Examiner*—Lloyd A. Gall
*Attorney, Agent, or Firm*—Ladas & Parry

[57] ABSTRACT

A latch bolt operating device is adapted for use with a latch bolt unit that is installed in a door panel, and includes exterior and interior operating units. The exterior operating unit includes a key-operated plug-and-cylinder lock assembly, and an exterior housing having an outer annular cover, an inner annular cover and an annular shield. The outer annular cover has a rear end portion formed with a first annular shoulder. The inner annular cover is received in the outer annular cover and has a rear end portion formed with a second annular shoulder. The annular shield extends into the rear end portion of the inner annular cover and has a peripheral portion which engages the second annular shoulder when the latter is bent. The interior operating unit includes a torque bar and an interior housing. The torque bar can be positioned releasably in a first position corresponding to an extended position of a bolt of the latch bolt unit and a second position corresponding to a retracted position of the bolt.

11 Claims, 17 Drawing Sheets

LATCH BOLT OPERATING DEVICE

BACKGROUND OF THE INVENTION

1. Field of the Invention

The invention relates to a latch bolt operating device, more particularly to a latch bolt operating device which is simple in construction, easy to install, relatively inexpensive to fabricate and which has improved strength.

2. Description of the Related Art

Referring to FIGS. 1 and 2, a conventional door lock is shown to comprise a latch bolt unit 5 and a latch bolt operating device which includes exterior and interior operating units 6, 7. The exterior operating unit 6 includes an outer annular cover 61, an inner annular cover 62 and an annular shield 63 which can be assembled to form an exterior housing. During assembly, the annular shield 63 is placed against an open end of the inner annular cover 62. The outer annular cover 61 is sleeved over the inner annular cover 62, and a distal end portion of the outer annular cover 61 is then bent inwardly to retain the inner annular cover 62 and the annular shield 63 therein. Usually, the outer annular cover 61 is provided with an electroplated coating. However, the electroplated coating is easily damaged when the exterior housing is assembled. Therefore, rusting of the outer annular cover 61 near the bent end portion thereof normally occurs, thus affecting adversely the appearance of the exterior housing. In addition, the connection between the outer annular cover 61 and the annular shield 63 severely limits the shape and material that can be used for the outer annular cover 61. Furthermore, the exterior housing 6 is supported on the door panel by means of only two bolts 8. Thus, the application of a force (F), as shown in FIG. 2, can easily destroy the door lock.

Another drawback of the conventional latch bolt operating device resides in the structure of the interior operating unit 7. It is noted that, when a torque bar 72 of the interior operating unit 7 is rotated, the user is unable to determine whether the latch bolt unit 5 is still in engagement with or has ceased to engage the door frame (not shown). Thus, over rotation of the torque bar 72, which can affect the useful life of the door lock, or under rotation of the torque bar 72, which may hinder opening of the door, are likely to occur.

SUMMARY OF THE INVENTION

An object of the present invention is to provide a latch bolt operating device with an improved exterior operating unit which is simple in construction, easy to install, relatively inexpensive to fabricate and which has improved strength.

Another object of the present invention is to provide a latch bolt operating device with an improved interior operating unit to help minimize over rotation or under rotation of a torque bar thereof.

According to the present invention, a latch bolt operating device is adapted for use with a latch bolt unit that is installed in a door panel. The latch bolt unit includes a bolt for locking the door panel to a door frame, and a latch driving mechanism connected operably to the bolt for moving the bolt between extended and retracted positions. The latch bolt operating device comprises exterior and interior operating units.

The exterior operating unit includes: a key-operated plug-and-cylinder lock assembly having a front part formed with a radial flange, a rear part, and an actuating member which extends axially from the rear part and which is adapted to engage operably the latch driving mechanism of the latch bolt unit to move the bolt between the extended and retracted positions; and an exterior housing including an outer annular cover, an inner annular cover and an annular shield.

The outer annular cover includes a first front end portion and a first rear end portion. The outer annular cover is formed with a first axial hole which extends through the first front and the first rear end portions to permit extension of the rear part of the lock assembly therethrough. The first front end portion has a first annular recessed section around the first axial hole for receiving the radial flange of the lock assembly therein. The first rear end portion is formed with a first annular shoulder which includes a first radial part that extends outwardly from the first rear end portion, and a first axial part that extends rearwardly from the first radial part.

The inner annular cover is received in the outer annular cover and has a second front end portion, a second rear end portion and a second axial hole which extends through the second front and the second rear end portions to permit extension of the rear part of the lock assembly therethrough. The second front end portion has a second annular recessed section around the second axial hole for receiving the first annular recessed section of the outer annular cover therein. The second rear end portion is formed with a second annular shoulder which includes a second radial part that extends outwardly from the second rear end portion, and a second axial part that extends rearwardly from the second radial part.

The annular shield extends into the second rear end portion of the inner annular cover and is formed with a central hole through which the actuating member of the lock assembly extends. The second axial part is bent so as to clamp a peripheral portion of the annular shield toward the second radial part in order to retain the annular shield in the inner annular cover.

The interior operating unit includes: a torque bar having a handle portion and an actuating spindle which extends from the handle portion, the actuating spindle being adapted to be connected operably to the latch driving mechanism of the latch bolt unit to permit movement of the bolt between the extended and retracted positions when the torque bar is rotated; an interior housing including an outer cover formed with a spindle hole through which the actuating spindle extends rotatably; and positioning means for positioning releasably the torque bar in a first position corresponding to the extended position of the bolt and a second position corresponding to the retracted position of the bolt.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
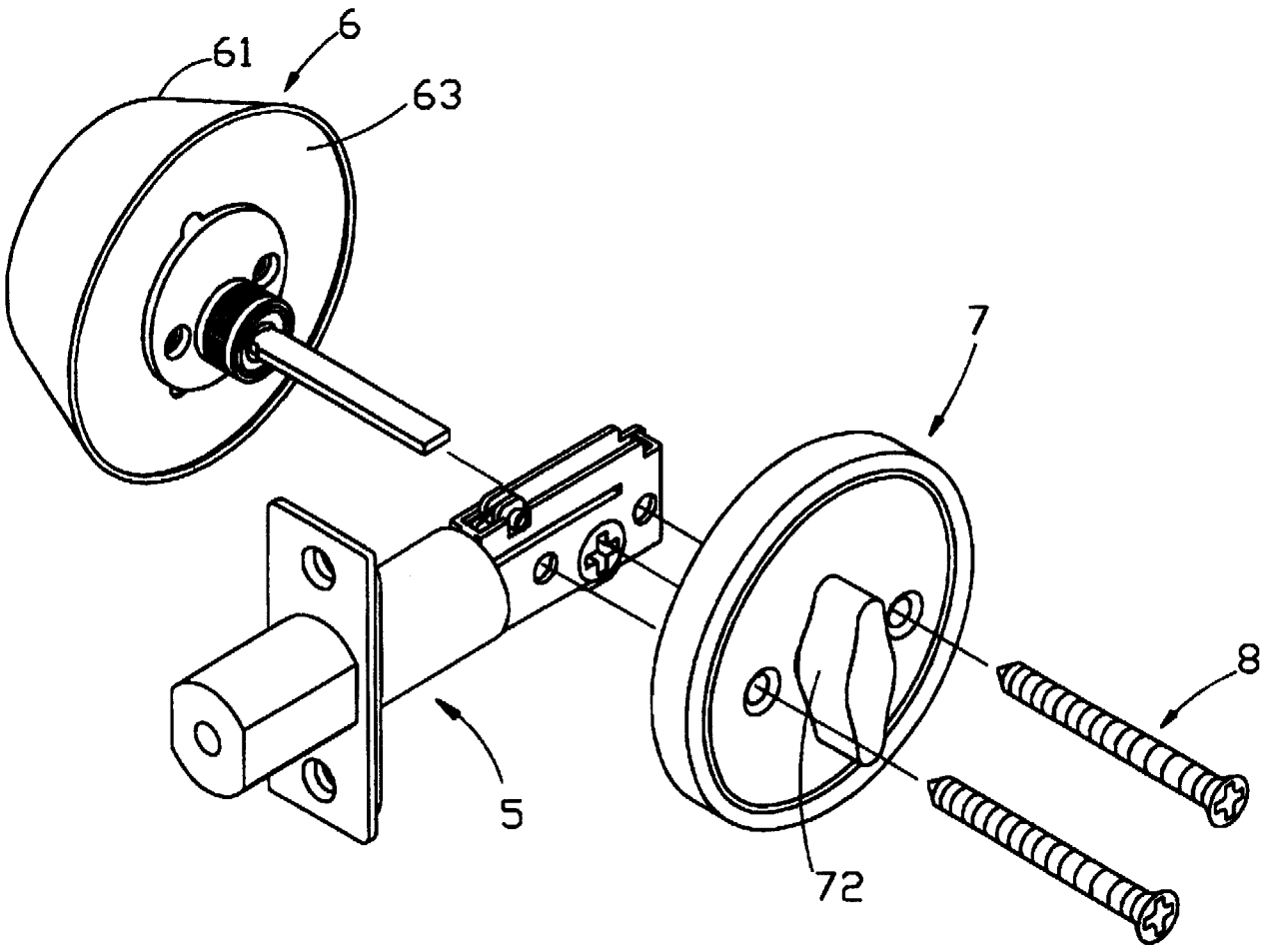
(PRIOR ART) FIG.1
FIG. 1 is an exploded view of a door lock with a conventional latch bolt operating device.
Figure 2:
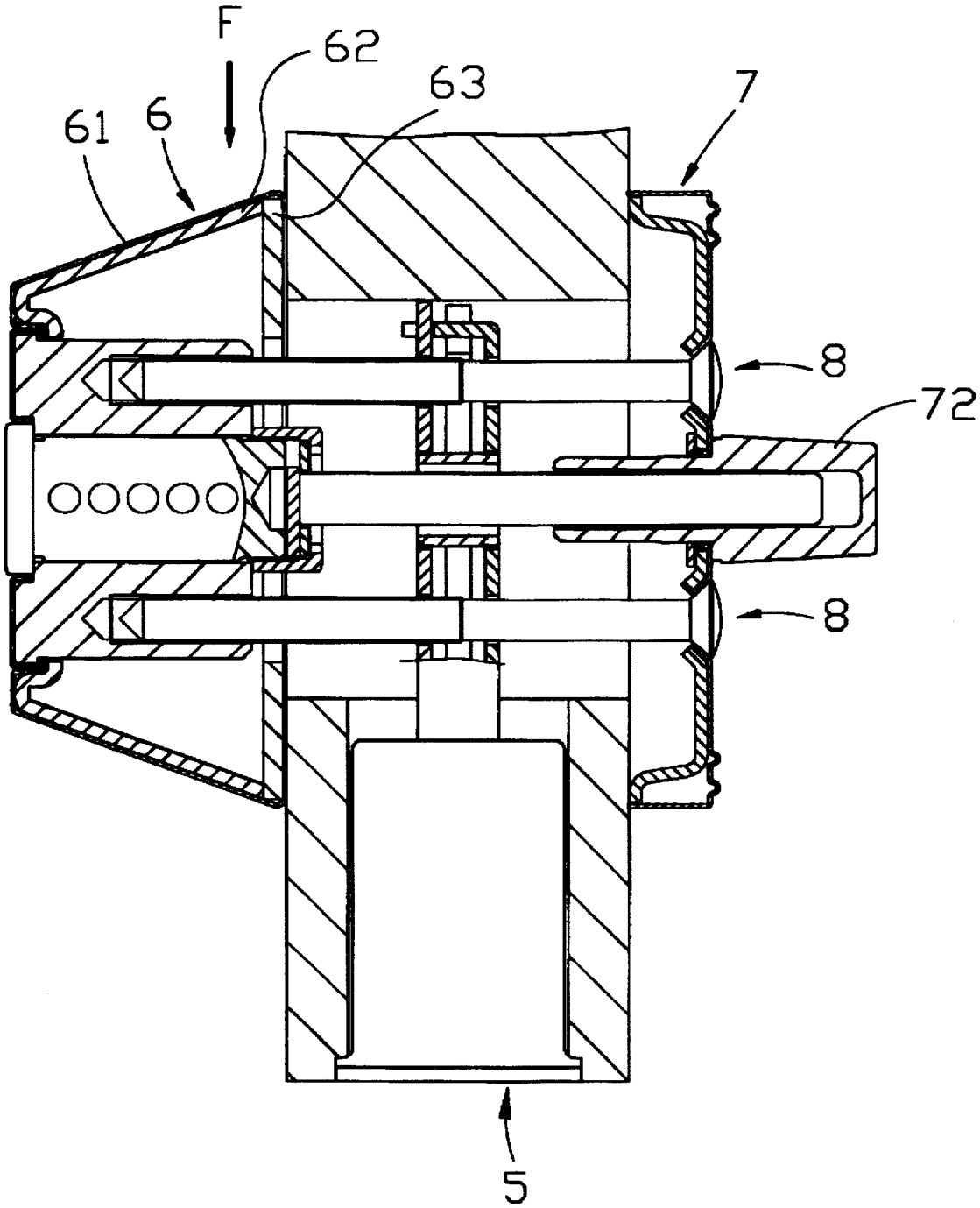
(PRIOR ART) FIG.2
FIG. 2 is a sectional view which illustrates the door lock of FIG. 1 when mounted on a door panel.

Before the present invention is described in greater detail, it should be noted that like elements are denoted by the same reference numerals throughout the disclosure.

Figure 3:
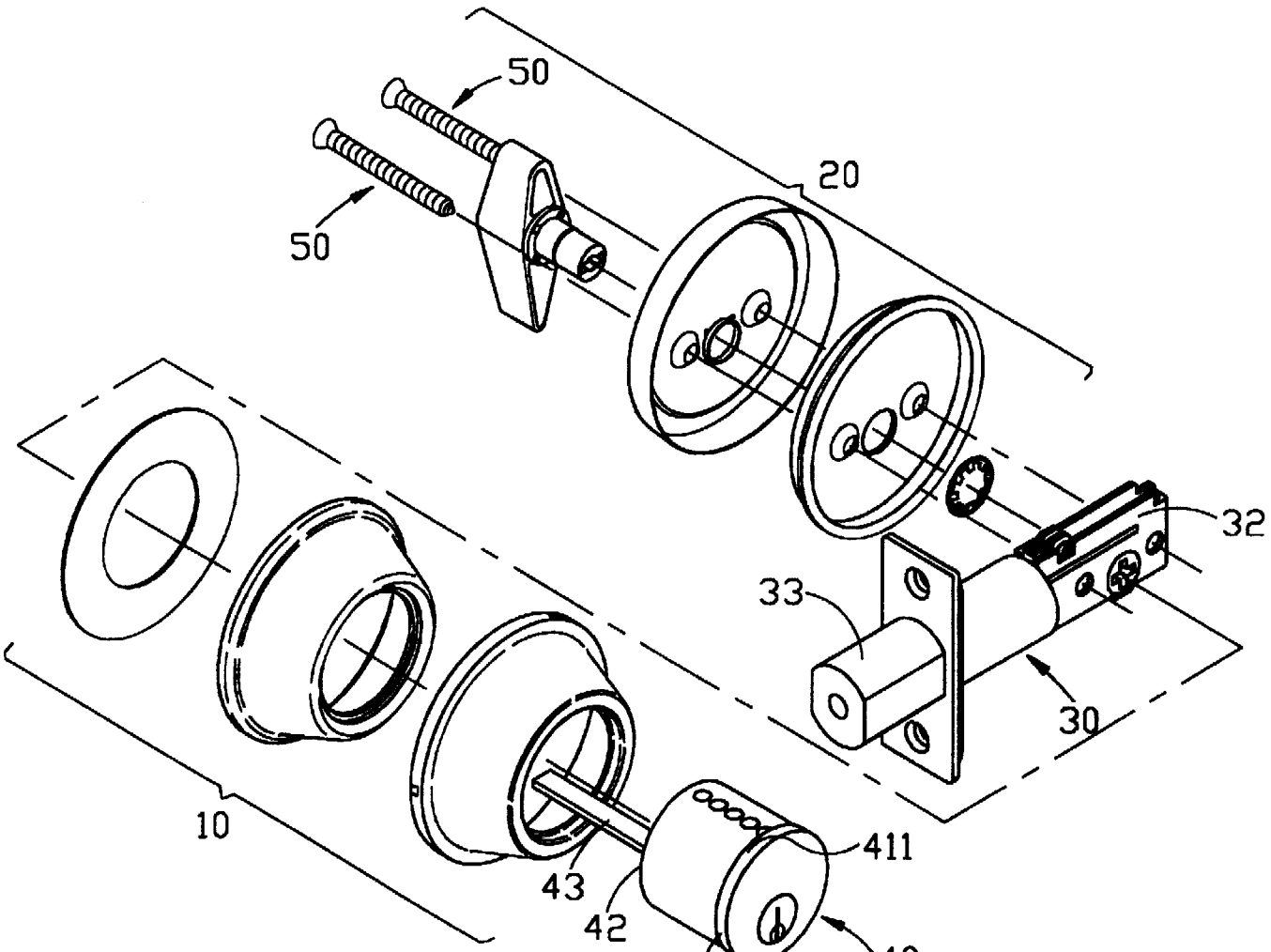
FIG. 3 is an exploded view of a door lock which incorporates the first preferred embodiment of a latch bolt operating device according to the present invention.

Referring to FIG. 3, a door lock is shown to comprise a conventional latch bolt unit 30 and the first preferred embodiment of a latch bolt operating device according to this invention. The latch bolt operating device includes exterior and interior operating units 10, 20.

The latch bolt unit 30 is to be installed in a door panel (not shown) and includes a bolt 33 for locking the door panel to a door frame (not shown), and a latch driving mechanism 32 connected operably to the bolt 33 for moving the latter between extended and retracted positions in a known manner.

The exterior operating unit 10 includes an exterior housing and a key-operated plug-and-cylinder lock assembly 40. The internal configuration of the lock assembly 40 is known in the art and will not be detailed herein. The lock assembly 40 has a front part 41 formed with a radial flange 411, a rear part 42, and an actuating member 43 which extends axially from the rear part 42 of the lock assembly 40. The actuating member 43 engages operably the latch driving mechanism 32 of the latch bolt unit 30 in a conventional manner so as to move the bolt 33 between the extended and retracted positions.

A pair of screws 50 extend through the interior operating unit 20 and engage threadedly with the lock assembly 40 to retain the door lock on the door.

Figure 4:
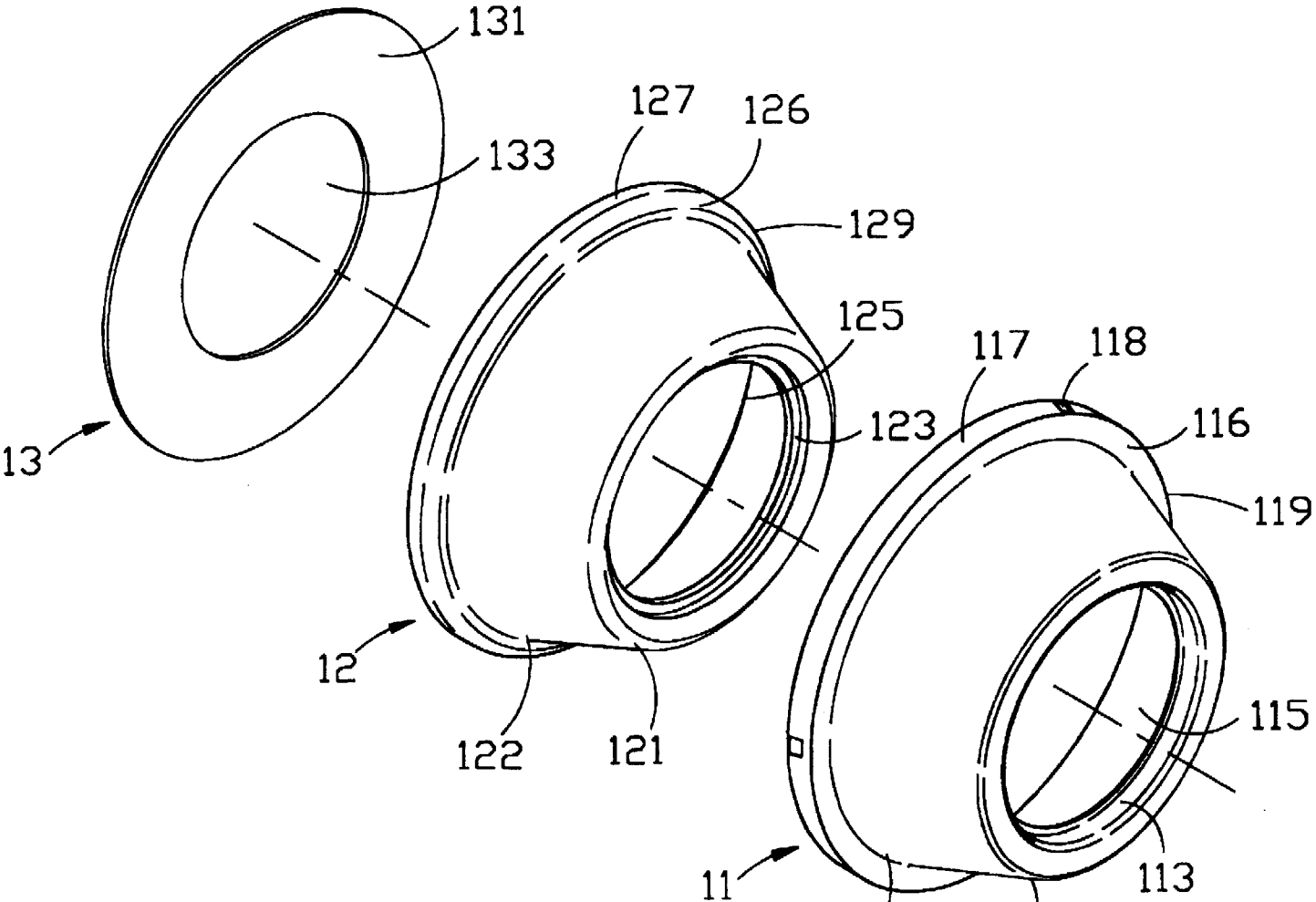
FIG. 4 is an exploded view of an exterior housing of the latch bolt operating device.

Referring to FIG. 4, the exterior housing of the exterior operating unit 10 is shown to comprise an outer annular cover 11, an inner annular cover 12 and an annular shield 13.

The outer annular cover 11 has a tapering construction with a first front end portion 111 and a wider first rear end portion 112. The outer annular cover 11 is formed with a first axial hole 115 which extends through the first front and first rear end portions 111, 112 and which permits extension of the rear part 42 of the lock assembly 40 therethrough. The first front end portion 111 is formed with an annular recessed section 113 around the first axial hole 115 for receiving the radial flange 411 of the lock assembly 40 therein. The first rear end portion 112 is formed with a first annular shoulder 119 which includes a first radial part 116 that extends outwardly from the first rear end portion 112, and a first axial part 117 that extends rearwardly from the first radial part 116. The first axial part 117 is provided with a plurality of angularly spaced and inwardly protruding bosses 118 that are formed by punching the first axial part 117 in a radial inward direction.

The inner annular cover 12 has a shape corresponding to that of the outer annular cover 11 and is to be received in the latter. The inner annular cover 12 has a second front end portion 121, a wider second rear end portion 122 and a second axial hole 125 which extends through the second front and second rear end portions 121, 122 and which permits extension of the rear part 42 of the lock assembly 40 therethrough. The second front end portion 121 is formed with a second annular recessed section 123 around the second axial hole 125 for receiving the first annular recessed section 113 therein. The second rear end portion 122 is formed with a second annular shoulder 129 which includes a second radial part 126 that extends outwardly from the second rear end portion 122, and a second axial part 127 that extends rearwardly from the second radial part 126.

The annular shield 13 includes an annular plate body 131 which is formed with a central hole 133 to permit extension of the actuating member 43 of the lock assembly 40 therethrough.

Figure 5:
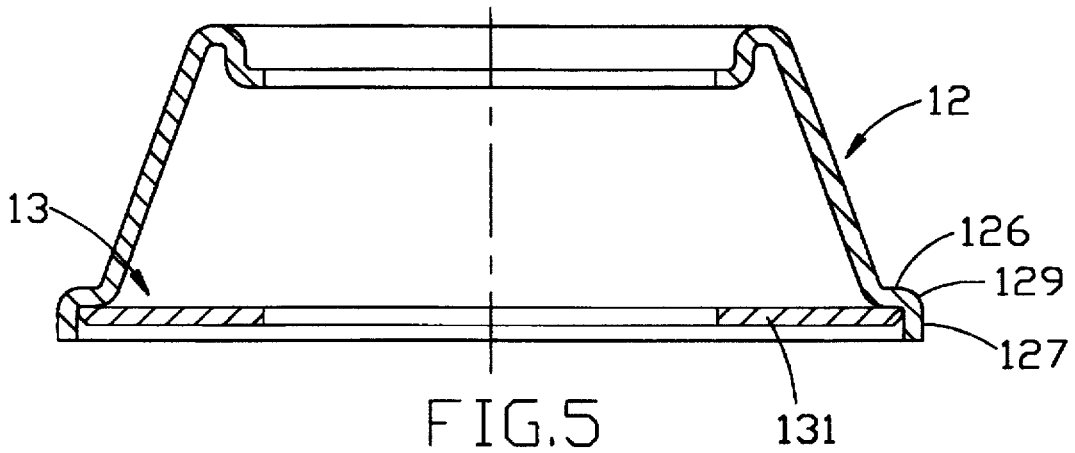
FIGS. 5, 6 and 7 are sectional views which illustrate how the exterior housing of the first preferred embodiment is assembled.
Figure 6:
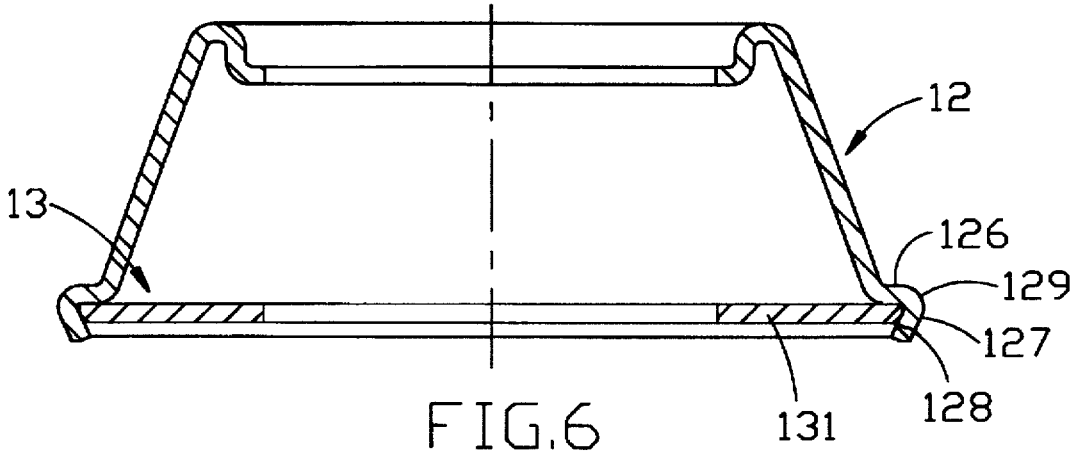
Figure 7:
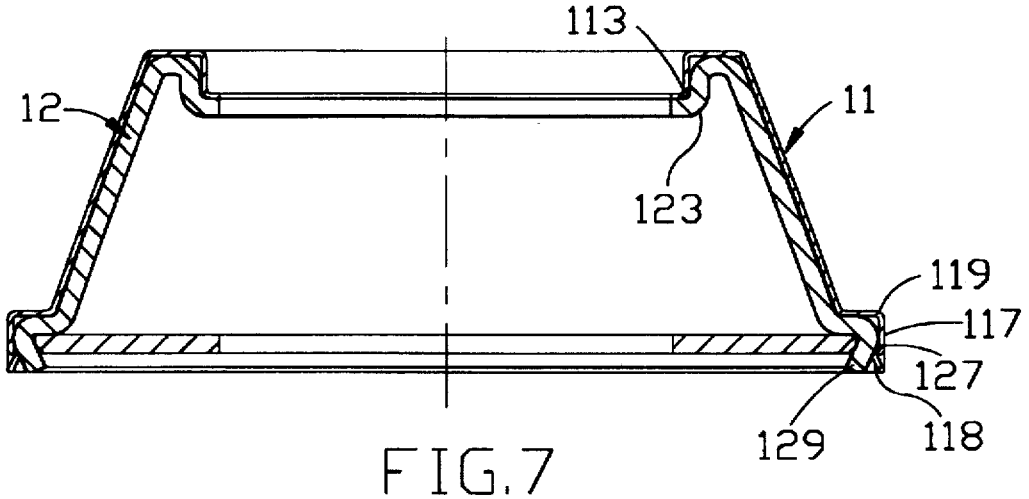

During assembly, the annular shield 13 is inserted into the second rear end portion 122 such that a peripheral portion of the annular shield 13 abuts against the second radial part 126 of the second annular shoulder 129, as shown in FIG. 5. The second axial part 127 of the second annular shoulder 129 is then bent in a radial inward direction so as to clamp the peripheral portion of the annular shield 13 between an inner face 128 of the second axial part 127 and the second radial part 126 of the second annular shoulder 129, thereby retaining the annular shield 13 in the inner annular cover 12, as shown in FIG. 6. The outer annular cover 11 is then sleeved over the inner annular cover 12, as shown in FIG. 7. At this time, the second annular recessed section 123 of the inner annular cover 12 receives the first annular recessed section 113 of the outer annular cover 11, and the bosses 118 on the first axial part 117 of the first annular shoulder 119 abut against the second axial part 127 of the second annular shoulder 129, thereby retaining the inner annular cover 12 in the outer annular cover 11. Preferably, the length of the first axial part 117 should be sufficient so as to conceal the second annular shoulder 129 and so as to abut against an outer side 91 of the door panel 90 when the exterior housing is installed on the latter, as shown in FIG. 9.

It has thus been shown that the inner annular cover 12 can be retained within the outer annular cover 11 without the need for bending the first annular shoulder 119 of the outer annular cover 11. Thus, the electroplated coating on the outer annular cover 11 is not damaged when the exterior housing is assembled, thereby preventing rusting of the outer annular cover 11. In addition, the connection between the outer annular cover 11 and the inner annular cover 12 permits replacement of the former with another cover member that has a different shape and that is made of a different material.

Figure 8:
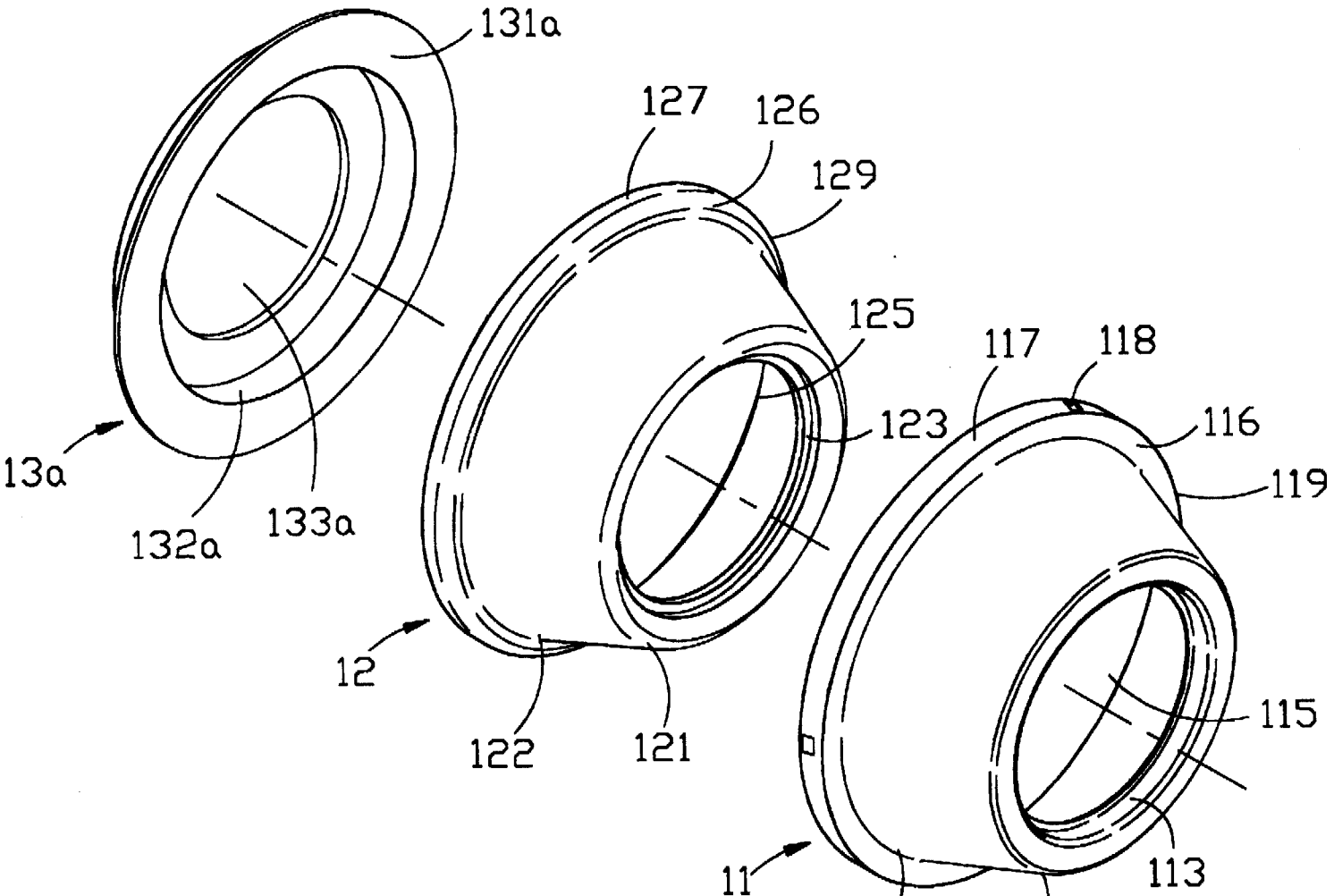
FIG. 8 is an exploded view of an exterior housing of a latch bolt operating device according to the second preferred embodiment of this invention.

The exterior housing of a latch bolt operating device according to the second preferred embodiment of this invention is shown in FIG. 8 to be generally similar to that of the previous embodiment, the main difference residing in the construction of the annular shield 13*a*. As illustrated, the annular shield 13*a* includes an annular plate body 131*a* which is formed with a central hole 133*a* to permit extension of the actuating member of the lock assembly therethrough. However, the plate body 131*a* further has an inner peripheral portion formed with a rearwardly and axially extending annular extension 132*a*.

Figure 9:
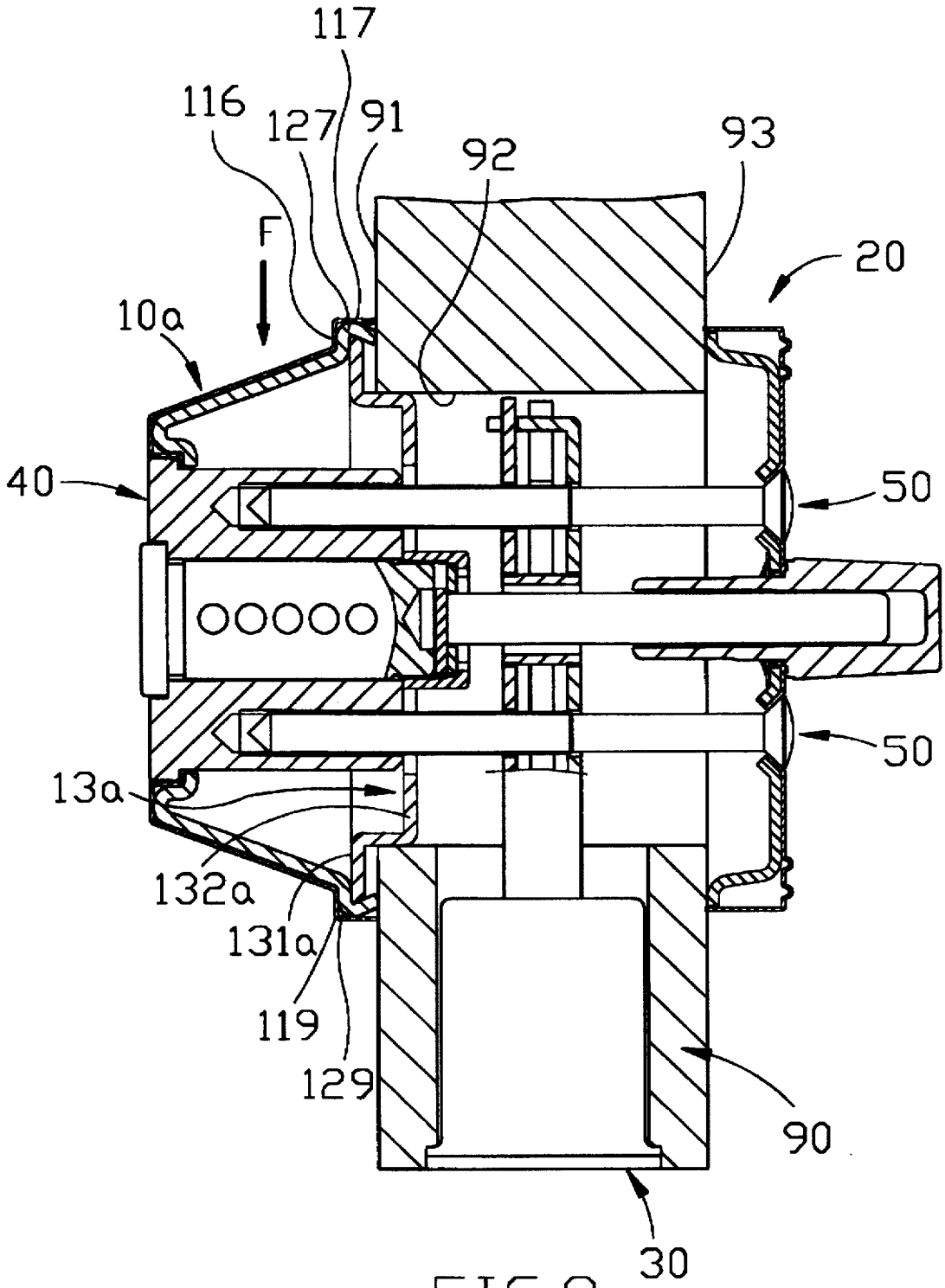
FIG. 9 is a sectional view which illustrates a door lock that incorporates the second preferred embodiment when installed on a door.

Referring to FIG. 9, when the exterior operating unit 10*a* of the second preferred embodiment is installed on a door panel 90, the annular extension 132*a* of the annular shield 13*a* extends into and abuts against a wall surface of a door hole 92 that is formed through outer and inner sides 91, 93 of the door panel 90. Thus, the annular extension 132*a* serves to anchor the exterior housing in order to strengthen the door lock which incorporates the second preferred embodiment of this invention so that the door lock is not easily destroyed when a force (F) is applied by a thief.

Figure 10:
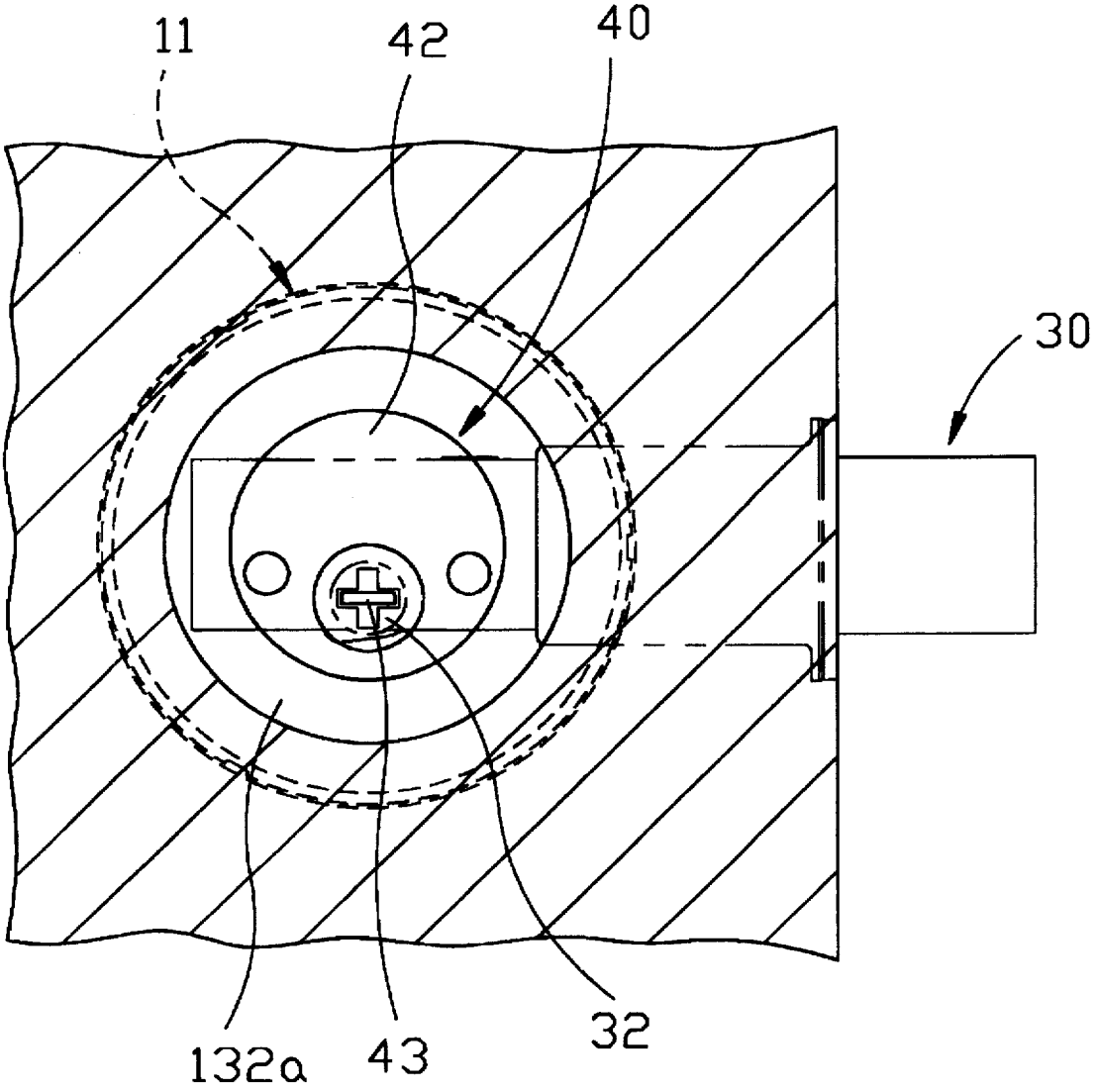
FIG. 10 is a sectional view of the door shown in FIG. 9, the exterior housing of the latch bolt operating device being shown in phantom lines.

Referring to FIGS. 8, 9 and 10, the rear part 42 of the lock assembly 40 is extended through the axial holes 115, 125 in the outer and inner annular covers 11, 12 when the lock assembly 40 is installed in the exterior housing. The axial holes 115, 125 guide movement of the lock assembly 40 to ensure proper engagement between the actuating member and the latch driving mechanism of the latch bolt unit 30. The screws 50 are then extended through the interior operating unit 20 so as to engage threadedly with the lock assembly 40 in order to retain the door lock on the door panel 90, as shown in FIG. 9.

Figure 11:
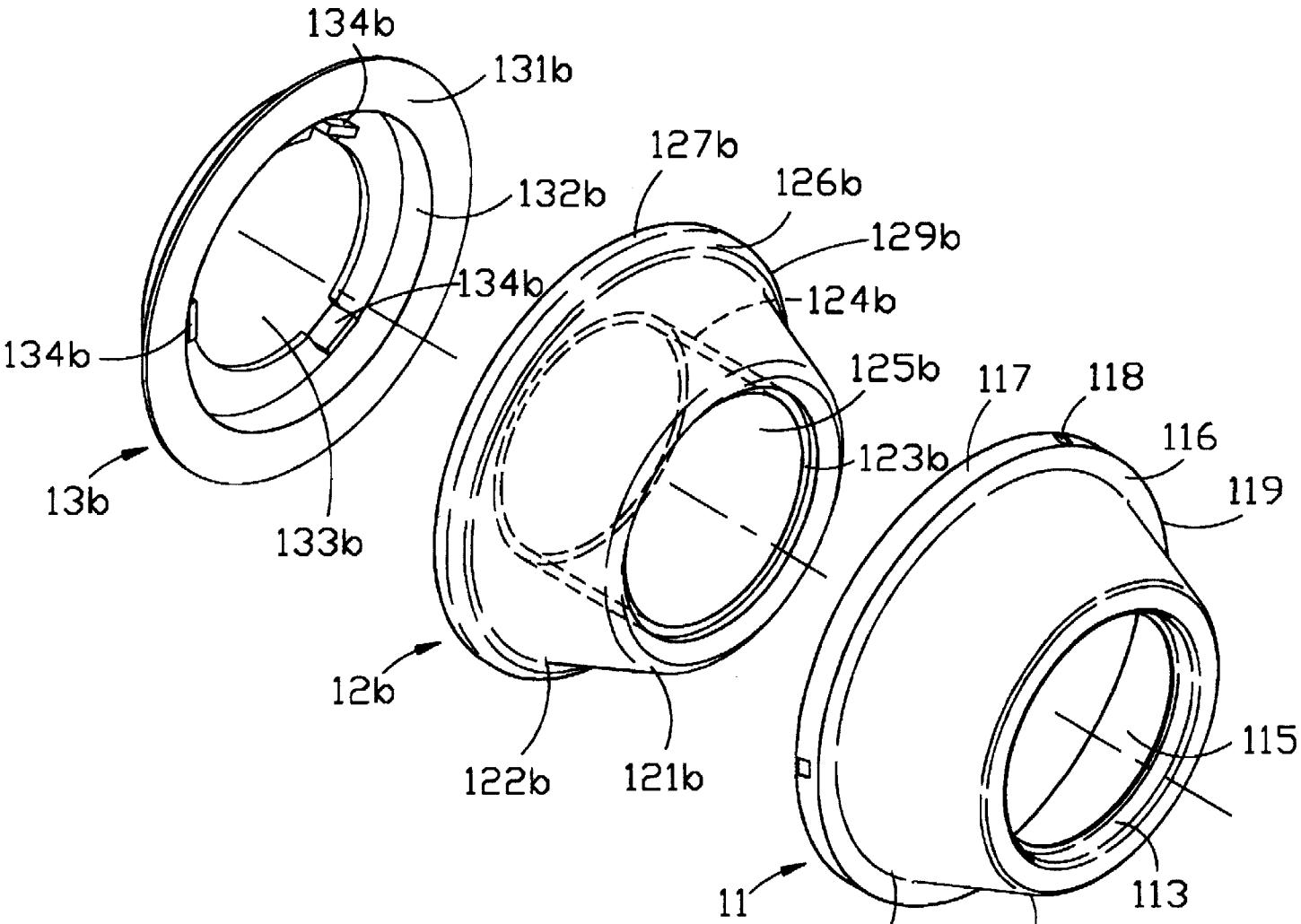
FIG. 11 is an exploded view of an exterior housing of a latch bolt operating device according to the third preferred embodiment of this invention.

FIG. 11 is an exploded view of an exterior housing of a latch bolt operating device according to the third preferred embodiment of this invention. The exterior housing of this embodiment is generally similar to that of the second preferred embodiment, the main difference residing in the constructions of the inner annular cover 12*b* and the annular shield 13*b*.

The inner annular cover 12*b* has a front end portion 121*b*, a wider rear end portion 122*b* and an axial hole 125*b* which extends through the front and rear end portions 121*b*, 122*b*. The front end portion 121*b* is formed with an annular recessed section 123*b* around the hole 125*b*, and a tubular post 124*b* which extends rearwardly and axially from the annular recessed section 123*b* and which confines the axial hole 125*b* therein. The rear end portion 122*b* is formed with an annular shoulder 129*b* which includes a radial part 126*b* that extends outwardly from the rear end portion 122*b*, and an axial part 127*b* that extends rearwardly from the radial part 126*b*.

Figure 12:
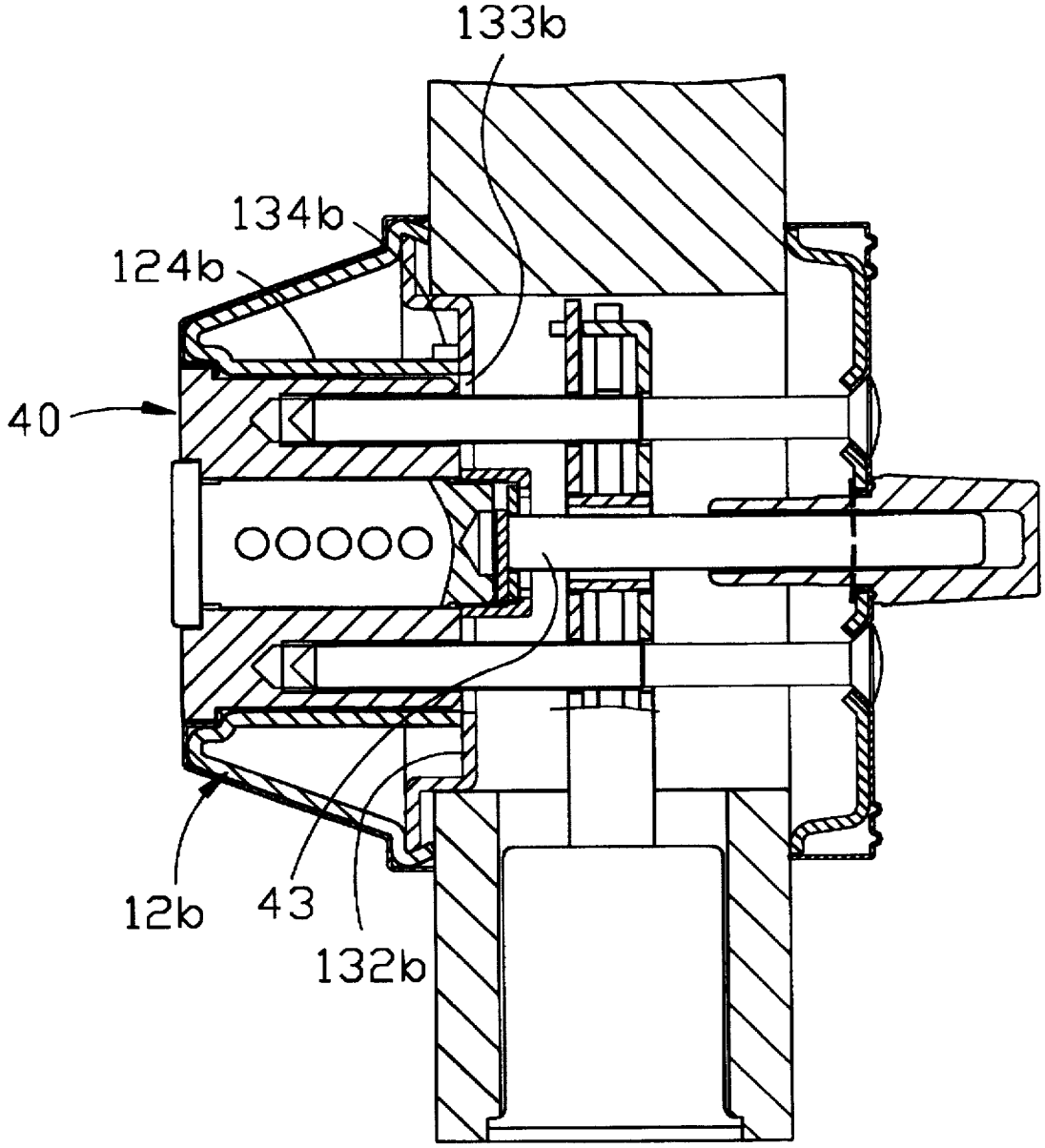
FIG. 12 is a sectional view which illustrates a door lock that incorporates the third preferred embodiment when installed on a door.

The annular shield 13*b* includes an annular plate body 131*b* which is formed with a central hole 133*b* and which has an inner peripheral portion that is provided with a rearwardly and axially extending annular extension 132*b*. The annular extension 132*b* has a radial inward end wall with an inner peripheral portion that is provided with a plurality of angularly spaced and forwardly extending guide blocks 134*b*. As shown in FIG. 12, the guide blocks 134*b*, which are formed by punching the end wall of the annular extension 132*b* in an axial forward direction, slidably engage the tubular post 124*b* of the inner annular cover 12*b* to strengthen a door lock which incorporates the third preferred embodiment.

Figure 13:
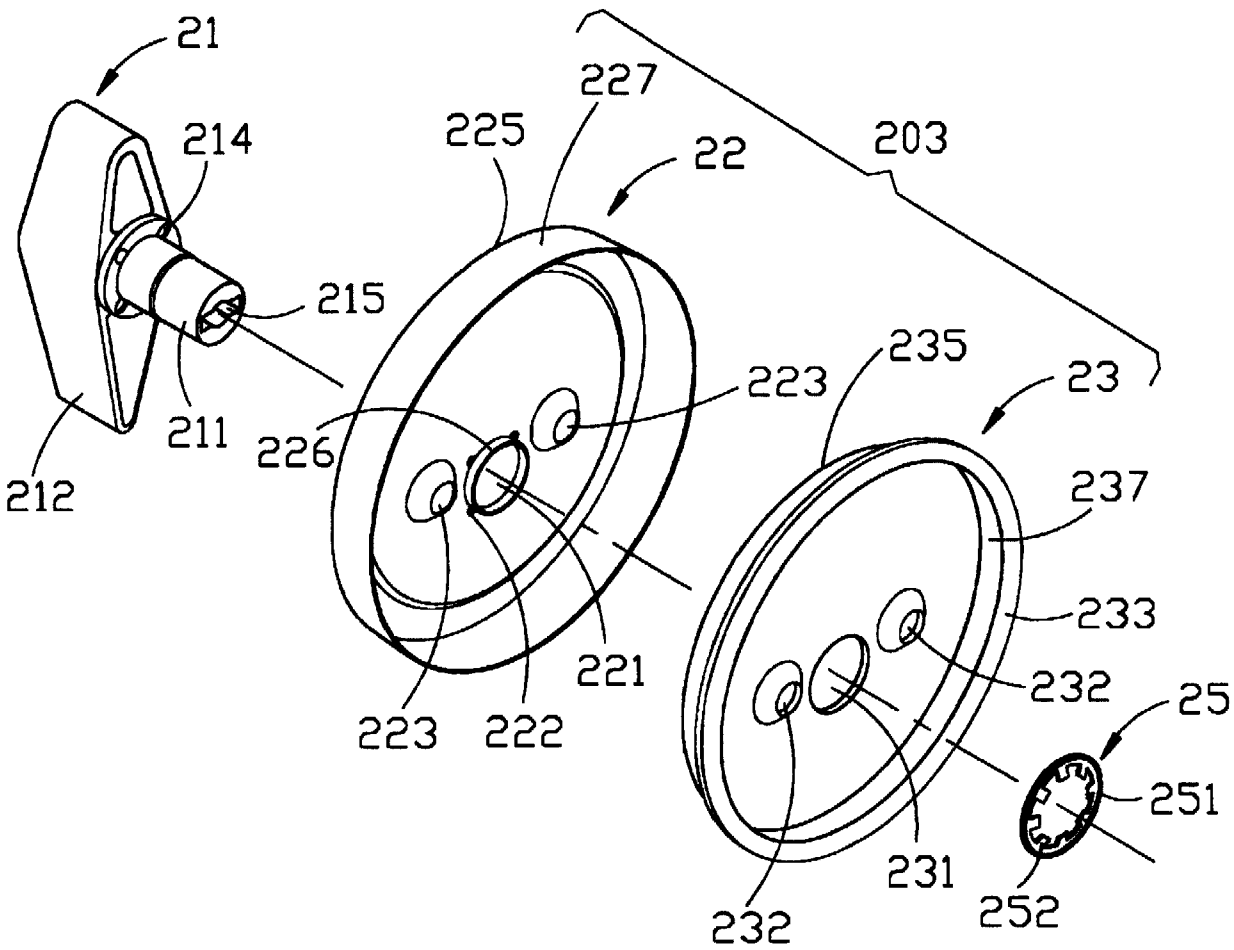
FIG. 13 is an exploded view of an interior operating unit of the first preferred embodiment.

Referring to FIG. 13, the interior operating unit of the first preferred embodiment of the latch operating device according to the present invention is shown to comprise a torque bar 21, an interior housing 203 and a biasing unit. The interior housing 203 includes an outer cover 22 and an inner cover 23.

Figure 14:
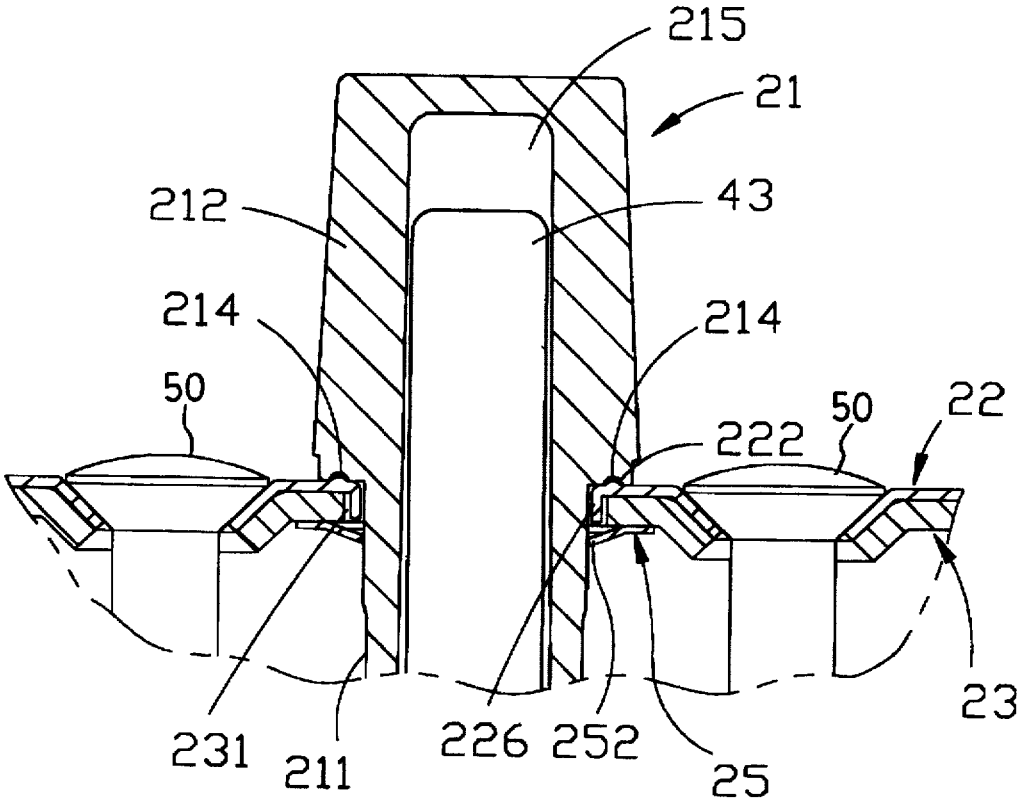
FIG. 14 is a fragmentary sectional view which illustrates the interior operating unit of FIG. 13 when assembled.

The torque bar 21 has a handle portion 212 and an actuating spindle 211 which extends from a rear side of the handle portion 212. The actuating spindle 211 is connected operably to the latch driving mechanism 32 of the latch bolt unit 30 (see FIG. 3) in a conventional manner so as to permit movement of the bolt 33 between the extended and retracted positions when the torque bar 21 is rotated. The rear side of the handle portion 212 is formed with a plurality of angularly spaced positioning recesses 214. In this embodiment, the actuating spindle 211 is a hollow member which is formed with an axial engaging hole 215 for engaging one end of the actuating member 43 of the lock assembly 40, as shown in FIG. 14.

The outer cover 22 includes a circular first plate body 225 and a first peripheral skirt 227 which extends rearwardly from the first plate body 225 and which is adapted to contact the inner side of a door panel when the interior operating unit is installed. The first plate body 225 is formed with a spindle hole 221 through which the actuating spindle 211 of the torque bar 21 extends rotatably. The first plate body 225 is further formed with a tubular extension 226 which extends rearwardly and which is disposed around the spindle hole 221, a plurality of angularly spaced rounded positioning protrusions 222 disposed at a front surface of the first plate body 225 to engage slidably the positioning recesses 214 in the handle portion 212 of the torque bar 21, and a pair of mounting holes 223 at opposite sides of the spindle hole 221 to permit extension of the screws 50 therethrough, as shown in FIG. 14. The positioning recesses 214 and the positioning protrusions 222 constitute a positioning unit for positioning releasably the torque bar 21 in a first position corresponding to the extended position of the bolt 33 and a second position corresponding to the retracted position of the bolt 33.

The inner cover 23 extends into the outer cover 22 and includes a circular second plate body 235 and a second peripheral skirt 237 which extends rearwardly from the second plate body 235. The second plate body 235 is formed with a through-hole 231 through which the tubular extension 226 on the outer cover 22 extends, as shown in FIG. 14. The second peripheral skirt 237 is formed with a radial outward flange 233 which extends to the first peripheral skirt 227 of the outer cover 22 when the inner cover 23 is disposed in the latter and which is adapted to be placed against the inner side of the door panel when the interior operating unit is installed on the same. The second plate body 235 is further formed with a pair of mounting holes 232 that are aligned with the mounting holes 223 in the outer cover 22.

In this embodiment, the biasing unit includes an internally toothed washer 25. The washer 25 is formed as a ring 251 with an inner periphery that is provided with a plurality of angularly spaced resilient teeth 252. Referring to FIG. 14, the washer 25 is sleeved on the actuating spindle 211 of the torque bar 21 at a rear side of the inner cover 23 such that the resilient teeth 252 of the washer 25 engage the surface of the actuating spindle 211 to provide resistance against axial movement of the actuating spindle 211 away from the interior housing 203.

Figure 15:
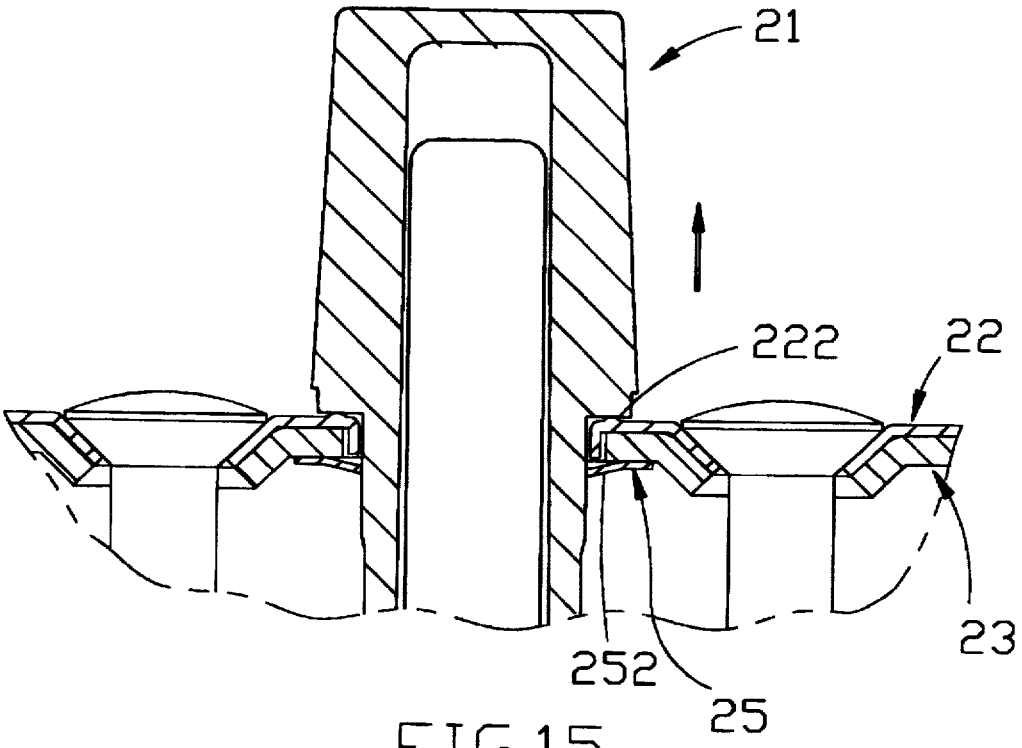
FIG. 15 is a fragmentary sectional view illustrating the interior operating unit of FIG. 13 when in use.

As shown in FIG. 15, when the torque bar 21 is rotated relative to the interior housing 203 from the first position to the second position, sliding disengagement between the positioning recesses 214 and the positioning projections 222 occurs. At this time, the actuating spindle 211 moves axially away from the interior housing 203 to result in deformation of the resilient teeth 252 of the washer 25. When the torque bar 21 reaches the second position, the positioning projections 222 engage the positioning recesses 214, thereby enabling the resilient teeth 252 to pull the actuating spindle 211 toward the interior housing 203. Thus, in view of the novel construction of the interior operating unit, over rotation or under rotation of the torque bar 21 can be avoided.

Figure 16:
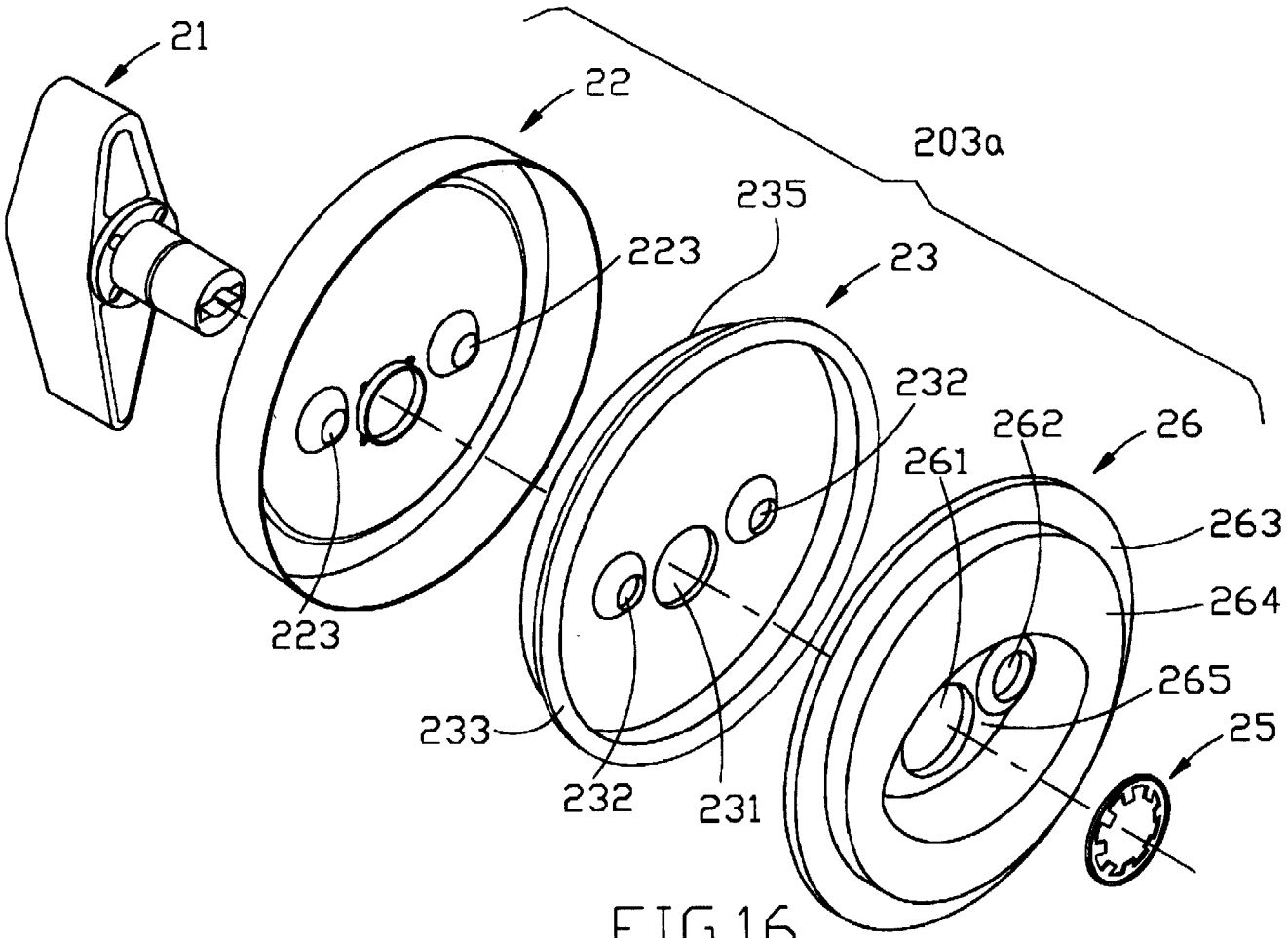
FIG. 16 is an exploded view of an interior operating unit of a latch bolt operating device according to the fourth preferred embodiment of this invention.
Figure 17:
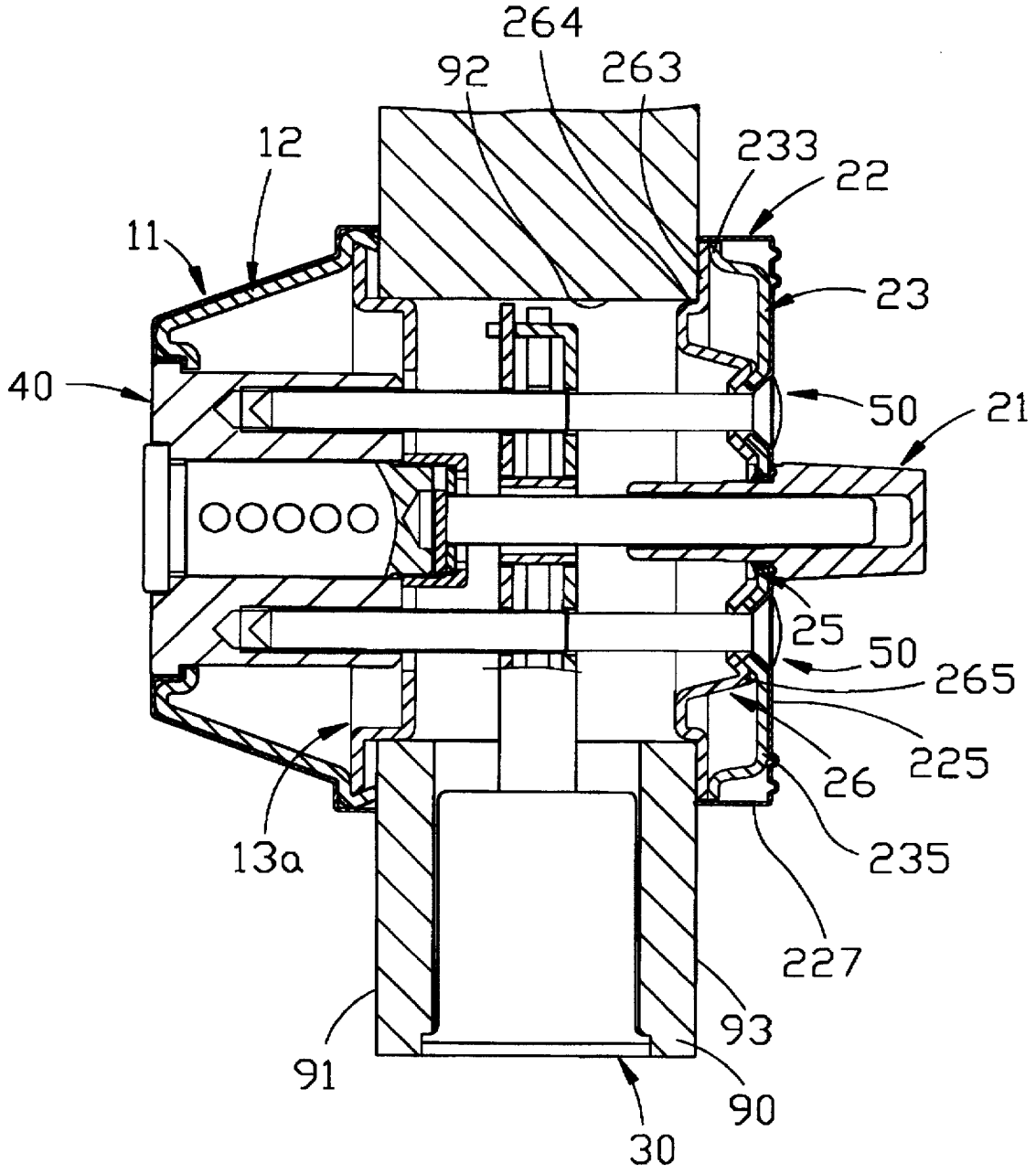
FIG. 17 is a sectional view which illustrates a door lock that incorporates the fourth preferred embodiment when installed on a door.

Referring to FIGS. 16 and 17, the interior housing 203*a* of the interior operating unit of a latch bolt operating device according to the fourth preferred embodiment of this invention is shown to further comprise a reinforcing shield 26. Preferably, the reinforcing shield 26 has a raised circular portion 265 which extends toward the second plate body 235 of the inner cover 23, and an annular recessed portion 264 around the raised circular portion 265. When the interior operating unit of this embodiment is installed on the door panel 90, the recessed portion 264 of the reinforcing shield 26 extends into and abuts against a wall surface of the door hole 92 that is formed through the outer and inner sides 91, 93 of the door panel 90. Thus, the reinforcing shield 26 serves to anchor the interior housing to the door panel 90 in order to strengthen the interior operating unit against forces that are exerted by the screws 50 when the interior operating unit is installed on the door panel 90. The reinforcing shield 26 is further provided with an annular peripheral portion 263 which extends around the recessed portion 264 to the first peripheral skirt 227 on the outer cover 22 when the reinforcing shield 26 is disposed in the latter. The peripheral portion 263 is clamped between the outward flange 233 of the inner cover 23 and the inner side 93 of the door panel 90. The raised circular portion 265 is formed with a hole 261 and a pair of mounting holes 262 that are aligned with the hole 231 and the mounting holes 232 in the inner cover 23, respectively.

Figure 18:
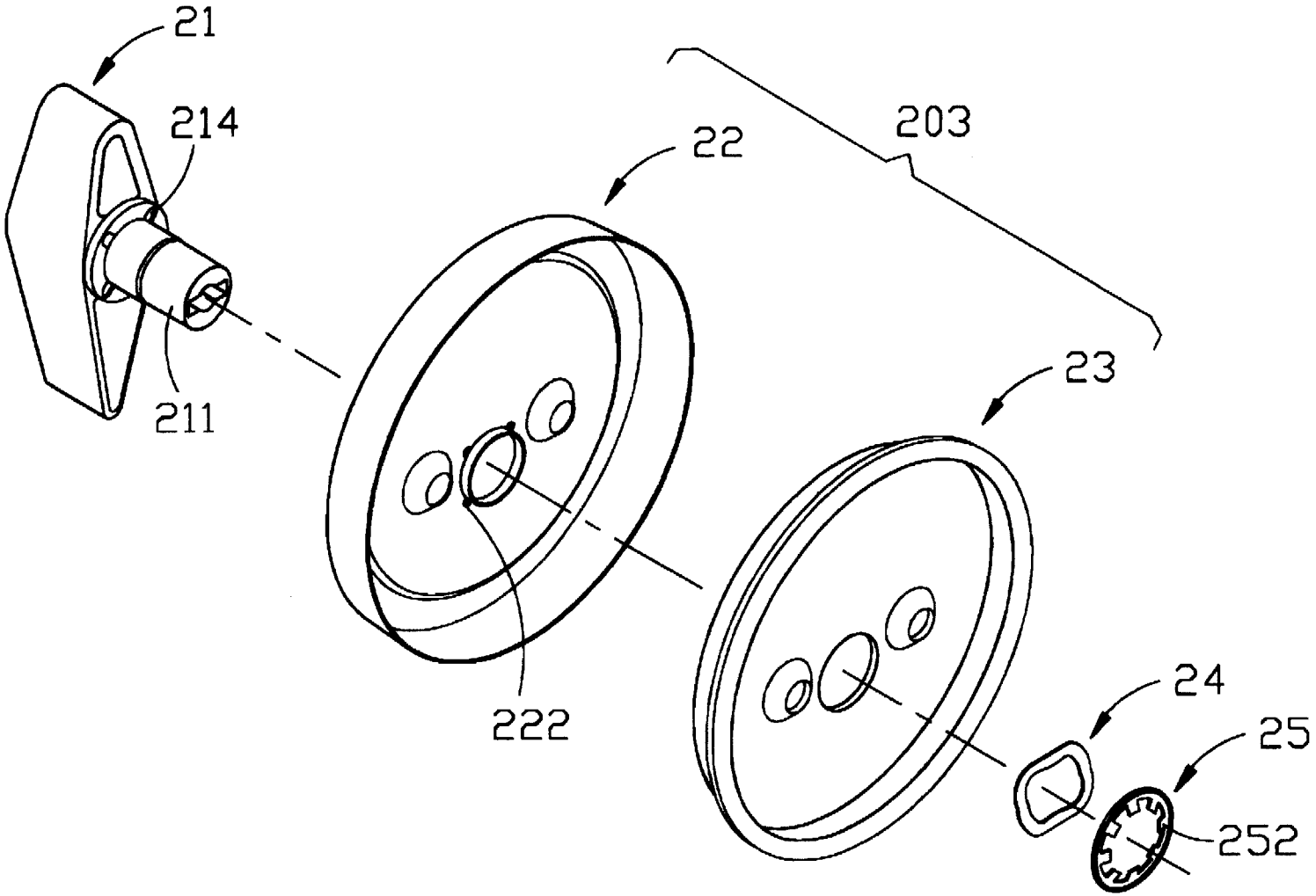
FIG. 18 is an exploded view of an interior operating unit of a latch bolt operating device according to the fifth preferred embodiment of this invention.

Referring to FIG. 18, the interior operating unit of the fifth preferred embodiment of a latch operating device according to the present invention is shown to be substantially similar to that of the first preferred embodiment, the main difference residing in that the biasing unit further includes a wavy annular spring 24 which is sleeved on the actuating spindle 211 between the washer 25 and the inner cover 23. The annular spring 24 enhances the biasing effect of the biasing unit.

Figure 19:
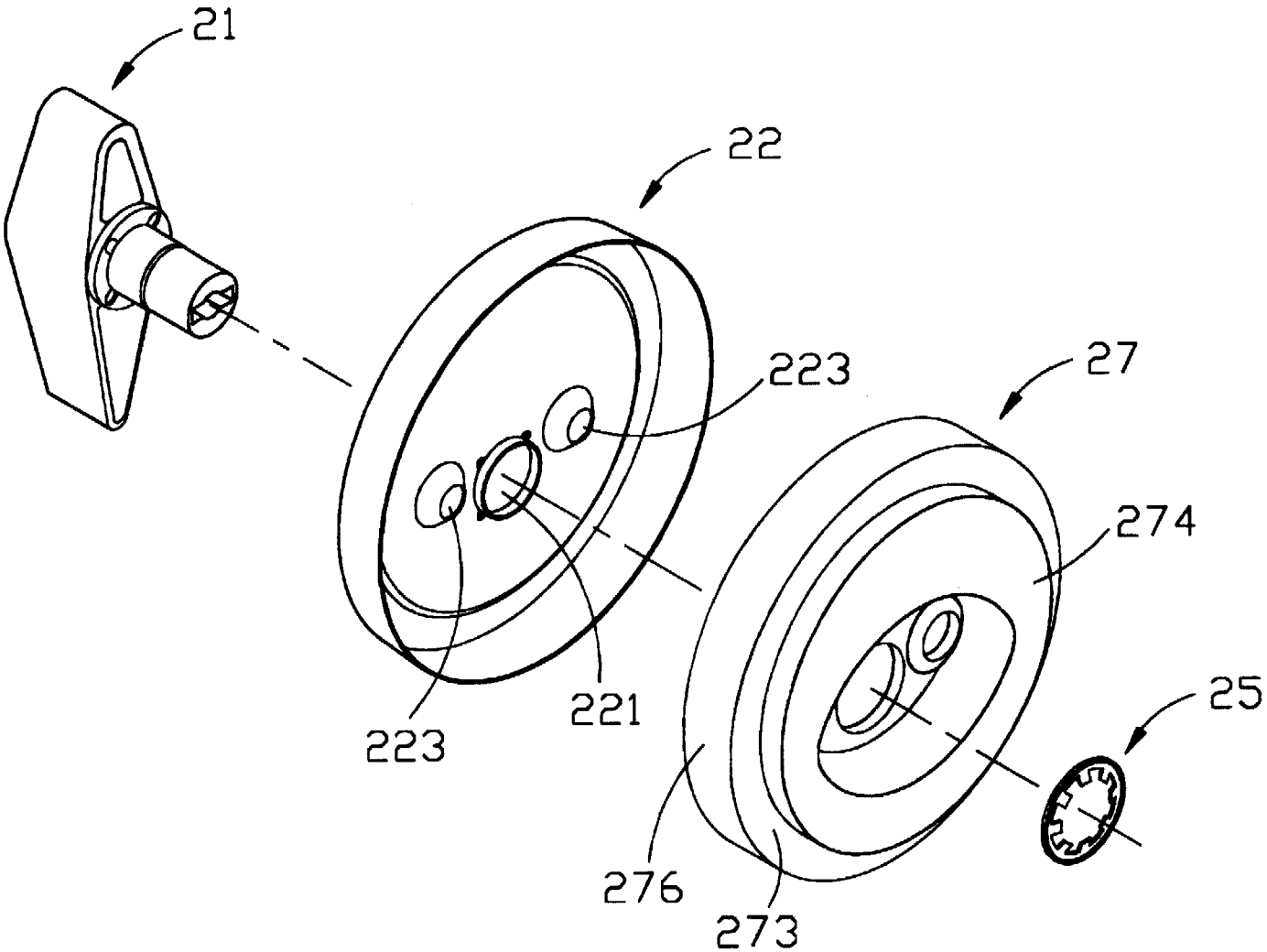
FIG. 19 is an exploded view of an interior operating unit of a latch bolt operating device according to the sixth preferred embodiment of this invention.
Figure 20:
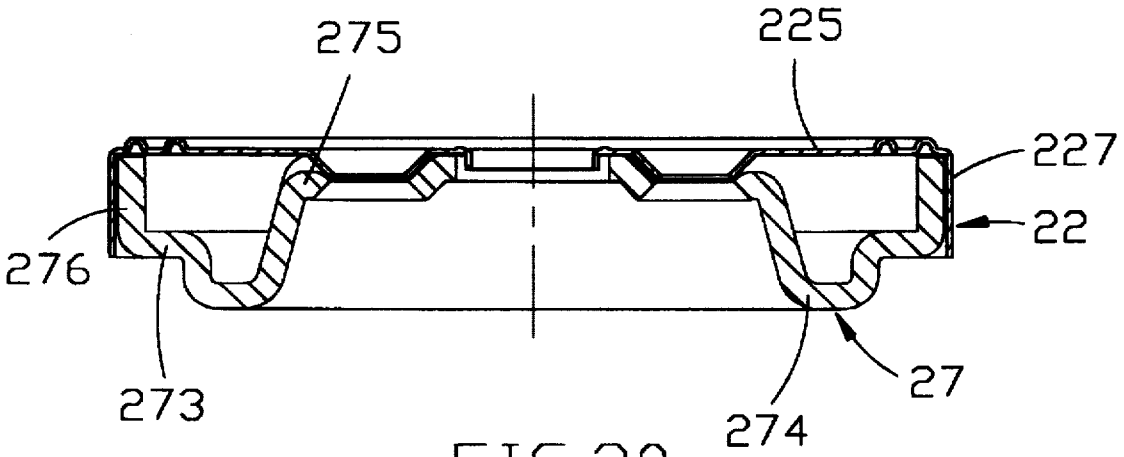
FIG. 20 is a sectional view of an interior housing of the interior operating unit of the sixth preferred embodiment.

The interior housing of an interior operating unit of the latch bolt operating device according to the sixth preferred embodiment of this invention is shown in FIGS. 19 and 20. As illustrated, the interior housing of this embodiment includes an inner cover 27 which replaces the inner cover 23 and the reinforcing shield 26 of the interior housing of the fourth preferred embodiment. The inner cover 27 has a raised circular portion 275 which extends toward the first plate body 225 of the outer cover 22, and an annular recessed portion 274 around the raised circular portion 275. As with the reinforcing shield 26 of the fourth preferred embodiment, the recessed portion 274 extends into and abuts against a wall surface of a door hole that is formed through outer and inner sides of a door panel (not shown) when the interior operating unit is installed on the same. The inner cover 27 is further provided with an annular peripheral portion 273 which extends around the recessed portion 274 to the first peripheral skirt 227 of the outer cover 22 when the inner cover 27 is inserted into the latter. The peripheral portion 273 abuts against the inner side of the door panel when the interior operating unit is installed. The inner cover 27 is further provided with a tubular wall 276 that extends from the peripheral portion 273 toward the first plate body 225 of the outer cover 22.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A housing for a lock assembly, comprising:

an outer annular cover including a first front end portion and a first rear end portion, said outer annular cover being formed with a first axial hole which extends through said first front and said first rear end portions and which is adapted to permit extension of the lock assembly therethrough, said first rear end portion being formed with a first annular shoulder which includes a first radial part that extends outwardly from said first rear end portion, and a first axial part that extends rearwardly from said first radial part;

an inner annular cover being received in said outer annular cover and having a second front end portion, a second rear end portion and a second axial hole which extends through said second front and said second rear end portions and which is adapted to permit extension of the lock assembly therethrough, said second rear end portion being formed with a second annular shoulder which includes a second radial part that extends outwardly from said second rear end portion, and a second axial part that extends rearwardly from said second radial part;

said first axial part of said first annular shoulder being provided with at least one inwardly protruding boss that abuts against said second axial part of said second annular shoulder to retain said inner annular cover in said outer annular cover; the lock assembly having a front part formed with a radial flange, wherein said first front end portion has a first annular recessed section around said first axial hole and adapted for receiving the radial flange of the lock assembly therein, said second front end portion having a second annular recessed section around said second axial hole for receiving said first annular recessed section of said outer annular cover therein.

2. The housing of claim 1, further comprising an annular shield that extends into said second rear end portion of said inner annular cover, said second axial part being bent so as to clamp a peripheral portion of said annular shield toward said second radial part in order to retain said annular shield in said inner annular cover.

3. The housing of claim 1, wherein said boss is formed by punching said first axial part of said first annular shoulder in a radial inward direction.

4. A latch bolt operating device adapted for use with a latch bolt unit that is installed in a door panel, the latch bolt unit including a bolt for locking the door panel to a door frame, and a latch driving mechanism connected operably to the bolt for moving the bolt between extended and retracted positions, said latch bolt operating device comprising:

an exterior operating unit including:

a key-operated plug-and-cylinder lock assembly having a front part formed with a radial flange, a rear part, and an actuating member which extends axially from said rear part and which is adapted to engage operably the latch driving mechanism of the latch bolt unit to move the bolt between the extended and retracted positions; and an exterior housing including an outer annular cover, an inner annular cover and an annular shield;

said outer annular cover including a first front end portion and a first rear end portion, said outer annular cover being formed with a first axial hole which extends through said first front and said first rear end portions to permit extension of said rear part of said lock assembly therethrough, said first front end portion having a first annular recessed section around said first axial hole for receiving said radial flange of said lock assembly therein, said first rear end portion being formed with a first annular shoulder which includes a first radial part that extends outwardly from said first rear end portion, and a first axial part that extends rearwardly from said first radial part;

said inner annular cover being received in said outer annular cover and having a second front end portion, a second rear end portion and a second axial hole which extends through said second front and said second rear end portions to permit extension of said rear part of said lock assembly therethrough, said second front end portion having a second annular recessed section around said second axial hole for receiving said first annular recessed section of said outer annular cover therein, said second rear end portion being formed with a second annular shoulder which includes a second radial part that extends outwardly from said second rear end portion, and a second axial part that extends rearwardly from said second radial part;

said annular shield extending into said second rear end portion of said inner annular cover and being formed with a central hole through which said actuating member of said lock assembly extends;

said second axial part being bent so as to clamp a peripheral portion of said annular shield toward said second radial part in order to retain said annular shield in said inner annular cover; and an interior operating unit including:

a torque bar having a handle portion and an actuating spindle which extends from said handle portion, said actuating spindle being adapted to be connected operably to the latch driving mechanism of the latch bolt unit to permit movement of the bolt between the extended and retracted positions when said torque bar is rotated;

an interior housing including an outer cover formed with a spindle hole through which said actuating spindle extends rotatably; and positioning means for positioning releasably said torque bar in a first position corresponding to the extended position of the bolt and a second position corresponding to the retracted position of the bolt.

5. A latch bolt operating device adapted for use with a latch bolt unit that is installed in a door panel, the latch bolt unit including a bolt for locking the door panel to a door frame, and a latch driving mechanism connected operably to the bolt for moving the bolt between extended and retracted positions, said latch bolt operating device comprising:

an exterior operating unit including:

a key-operated plug-and-cylinder lock assembly having a front part formed with a radial flange, a rear part, and an actuating member which extends axially from said rear part and which is adapted to engage operably the latch driving mechanism of the latch bolt unit to move the bolt between the extended and retracted positions; and an exterior housing including an outer annular cover, an inner annular cover and an annular shield;

said outer annular cover including a first front end portion and a first rear end portion, said outer annular cover being formed with a first axial hole which extends through said first front and said first rear end portions to permit extension of said rear part of said lock assembly therethrough, said first front end portion having a first annular recessed section around said first axial hole for receiving said radial flange of said lock assembly therein, said first rear end portion being formed with a first annular shoulder which includes a first radial part that extends outwardly from said first rear end portion, and a first axial part that extends rearwardly from said first radial part;

said inner annular cover being received in said outer annular cover and having a second front end portion, a second rear end portion and a second axial hole which extends through said second front and said second rear end portions to permit extension of said rear part of said lock assembly therethrough, said second front end portion having a second annular recessed section around said second axial hole for receiving said first annular recessed section of said outer annular cover therein, said second rear end portion being formed with a second annular shoulder which includes a second radial part that extends outwardly from said second rear end portion, and a second axial part that extends rearwardly from said second radial part;

said annular shield extending into said second rear end portion of said inner annular cover and being formed with a central hole through which said actuating member of said lock assembly extends;

said second axial part being bent so as to clamp a peripheral portion of said annular shield toward said second radial part in order to retain said annular shield in said inner annular cover.

6. The latch bolt operating device as claimed in claim 5, wherein said first axial part of said first annular shoulder is provided with at least one inwardly protruding boss that abuts against said second axial part of said second annular shoulder to retain said inner annular cover in said outer annular cover.

7. The latch bolt operating device as claimed in claim 6, wherein said boss is formed by punching said first axial part of said first annular shoulder in a radial inward direction.

8. The latch bolt operating device as claimed in claim 5, wherein said annular shield has an inner peripheral portion formed with a rearwardly and axially extending annular extension which is adapted to extend into a door hole that is formed through outer and inner sides of the door panel and which is adapted to abut against a wall surface of the door hole.

9. The latch bolt operating device as claimed in claim 8, wherein said second front end portion of said inner annular cover is formed with a tubular post which extends rearwardly and axially from said second annular recessed section.

10. The latch bolt operating device as claimed in claim 9, wherein said annular extension of said annular shield has a radial inward end wall with an inner peripheral portion that is provided with a plurality of angularly spaced and forwardly extending guide blocks, said guide blocks engaging slidably said tubular post of said inner annular cover.

11. The latch bolt operating device as claimed in claim 10, wherein said guide blocks are formed by punching said end wall of said annular extension in an axial forward direction.

* * * * *